United States Patent [19]

Johansson

[11] 4,165,942

[45] Aug. 28, 1979

[54] DISPOSABLE WASHING IMPLEMENT FOR PERSONAL BODY CARE

[76] Inventor: Hans A. V. Johansson, Trehäradsvägen 36, Eslöv, Sweden, 241 00

[21] Appl. No.: 815,155

[22] Filed: Jul. 13, 1977

[51] Int. Cl.[2] ..... B05C 1/00

[52] U.S. Cl. ..... 401/132; 401/203; 128/269

[58] Field of Search ..... 401/7, 196, 203, 204, 401/202, 132–135; 128/269, 263, 239, 266; 206/374, 375; 222/80

[56] References Cited

U.S. PATENT DOCUMENTS

| | | | |
|---|---|---|---|
| 1,487,167 | 3/1924 | Kumagawa | 401/203 |
| 2,519,555 | 8/1950 | Fields | 128/266 |
| 2,642,065 | 6/1953 | Negri | 128/272 X |
| 3,063,084 | 11/1962 | Marinus | 401/203 |
| 3,135,262 | 6/1964 | Kobler et al. | 128/263 X |
| 3,922,099 | 11/1975 | Christine et al. | 401/134 |

*Primary Examiner*—Clifford D. Crowder
*Attorney, Agent, or Firm*—William F. Frank

[57] ABSTRACT

A washing implement for personal body care comprises an elongated washing rod provided with a hand grip. The washing rod has a protective cover which is secured at the inner end of the washing rod to the hand grip. The protective cover opens at the top and is designed to be slipped down along the washing rod and over the hand grip to form a protective sleeve for the hand of the person using the washing rod.

2 Claims, 3 Drawing Figures

DISPOSABLE WASHING IMPLEMENT FOR PERSONAL BODY CARE

The present invention relates to an improved washing implement for personal body care of the type which comprises at least one elongated rod-like washing element interconnected with a handle. In prior art implements of this type it was not taken into consideration that the portions thereof which come into contact with the body should be adequately protected before use. In addition, it has often been necessary for reasons of hygiene to use protective gloves.

It is an object of the present invention to provide in a washing implement of the above-mentioned type an extremely simple arrangement adapted to protect the rod-like element before the implement is put to use, and which can also be used instead of a protective glove. This object is attained according to the invention essentially by the fact that the washing rod includes at least one protective cover which, upon being opened at one end to uncover the rod, can be converted so as to provide a protection which completely or partly encloses the hand grasping the handle to hold the implement.

The invention will be explained in greater detail hereinafter with reference to the accompanying drawing, in which.

Figure 1:
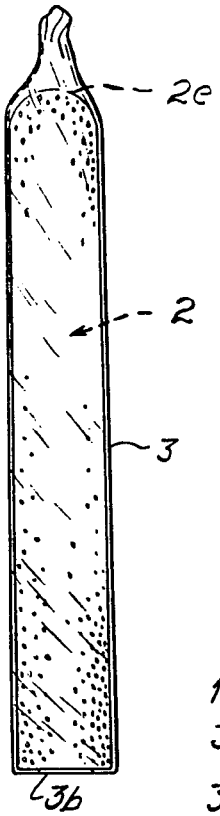
FIG. 1 is a side view of a washing rod provided with a protective cover.
Figure 2:
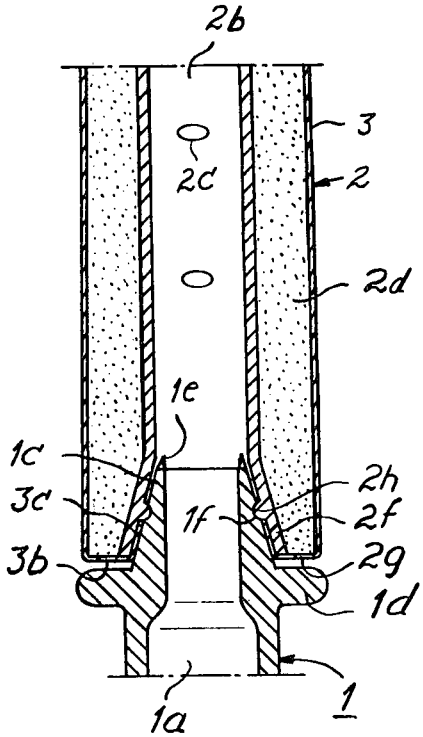
FIG. 2 is a sectional view of the connecting portion of the washing rod and a handle.
Figure 3:
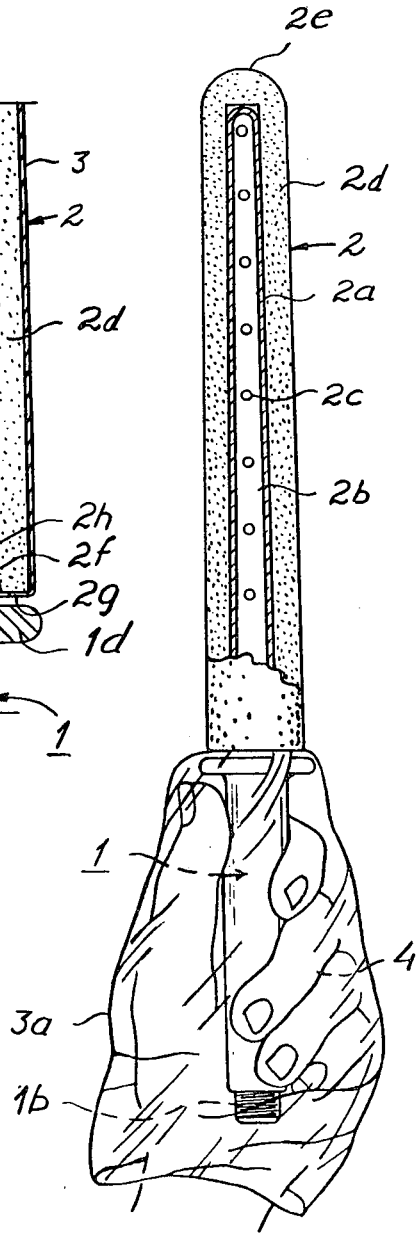
FIG. 3 illustrates the washing implement with its protective cover converted into a hand protection.

The washing implement according to the invention comprises a handle 1 having connected thereto a washing rod 2 which after use can be released from the handle 1 and discarded. The handle 1 has a through-flow passage 1*a*, and one end portion 1*b* thereof can be connected to a water hose (not shown).

The washing rod 2 comprises at least one tubular manifold passage 2*b* and at least one series of discharge orifices 2*c* extending from this passage 2*b*. A sleeve 2*d* of a porous, water-pervious material is fixedly or detachably mounted on the manifold tube 2*a*, the sleeve 2*d* serving as a washing sponge which is supplied with water from inside.

In order to protect the sleeve-shaped cleaning sponge 2*d* of the washing rod 2 against contamination before taking the implement into use, and to eliminate any need of using gloves in the washing operation, the washing rod 2 is provided with at least one protective cover 3 which can be opened up at one end 2*e* of the rod 2 and folded back to expose the rod 2, at the same time forming a protective sleeve 3*a* adapted completely or partly to cover the hand 4 gripping the handle 1 for holding the implement in use.

For the purpose of also preventing any foreign matter from entering the manifold passage 2*b* before taking the implement into use, the protective cover 3 can also close off the connecting portion 2*f* of the rod 2. Quick coupling can be provided by making the portion 3*b* of the protective cover 3 which covers the connecting portion 2*f*, so as to open by means of the handle 1 to establish communication between the supply passage 1*a* and the manifold passage 2*b*.

In order to provide for an effective fixation of the protective cover 3, a portion 3*c* of the latter may be clamped between cooperating opposed surfaces on the connecting portions 1*c* and 2*f* of the rod and handle, respectively. A particularly effective fixation of the protective cover 3 can be attained by providing the handle 1 with a flange portion 1*d* adjacent to its connecting portion 1*c*, a portion 3*b* of the protective cover 3 being clamped between this flange portion 1*d* and an opposite end-face 2*g* of the rod 2. The operation of cutting a hole in the protective cover 3 is facilitated by providing the connecting portion 1*c* of the handle with cutting elements, preferably in the form of teeth 1*e* projecting from the end face of the connecting portion 1*c*.

The fixation of the protective cover 3 can be secured by forming the cooperating connecting portions 1*c*, 2*f* with at least one snap-lock 1*f*, 2*h*, preferably in the form of at least one detent 2*h* and at least one mating recess 1*f*.

The construction of the implement thus described can be varied within the scope of the appended claims. Thus, for instance, a container for a detergent, such as soap, may be connected to the handle or to the supply hose. In addition, a joint (not shown) may be arranged between the handle and rod to enable the rod to be inclined relative to the handle.

The arrangement thus described provides extremely simple means for effectively protecting the rod before utilizing the implement and the implement holding hand when in use. Since the rod is readily detachable, it may be replaced by a new rod and be discarded after each use of the implement, if this is considered necessary for hygienical reasons, and a soiled protective cover can easily be removed from the handle and discarded.

What is claimed is:

1. A washing implement for personal body care comprising a handle and a disposable washing rod slidably connectable to one end of said handle, said washing rod having a protective cover which is formed into a hand protection after the interconnection of the rod and the handle, the washing rod including a connecting end which before its connection to a connecting portion of the handle is at least partially covered by one end portion of the protective cover, there being a separate but interconnectable water-supply passage extending through the handle and the washing rod respectively, the said connecting portion of the handle being conically tapering and slidably fitting into a corresponding conically tapering portion of said rod connecting end, the said connecting portion of the handle having means for puncturing said end portion of the protective cover when the washing rod and the handle are connected, the said punctured end of the protective cover being simultaneously tightly squeezed between the wall of the water-supply passage in the washing rod and said connecting portion of the handle slidingly projecting into said rod water-supply passage, the said wall of the rod water-supply passage and said connecting portion of the handle being each provided with means to interact to form a snap-fitting lock when the said rod and the said handle are slidingly interconnected.

2. The implement according to claim 1 wherein the other end of said protective cover is opened after said rod and said handle are slidingly interconnected and said other opened end is invertedly drawn down over said rod to cover said handle to form said hand protection.

* * * * *